US005302036A

United States Patent [19]

Akiyama et al.

[11] Patent Number: 5,302,036

[45] Date of Patent: Apr. 12, 1994

[54] MULTI-COLOR RIBBON CASSETTE POSITION ADJUSTING APPARATUS

[75] Inventors: Masahiro Akiyama, Numazu; Hidekazu Ishii; Kozo Hara, both of Shizuoka, all of Japan

[73] Assignee: Tokyo Electric Co., Ltd., Tokyo, Japan

[21] Appl. No.: 930,849

[22] Filed: Aug. 14, 1992

[30] Foreign Application Priority Data

Aug. 21, 1991 [JP] Japan ..... 3-209104
Sep. 11, 1991 [JP] Japan ..... 3-232009

[51] Int. Cl.[5] ..... B41J 33/14

[52] U.S. Cl. ..... 400/229; 400/208; 400/246

[58] Field of Search ..... 400/223, 225, 229, 208, 400/240, 247, 248, 216.1, 216.2

[56] References Cited

U.S. PATENT DOCUMENTS 4,425,046 1/1984 Van Horne et al. ..... 400/208
4,493,571 1/1985 Potter .
4,606,662 8/1986 Komplin ..... 400/229
4,641,150 2/1987 Matsuura et al. ..... 400/229
4,693,619 9/1987 Ishii et al. ..... 400/216.1
4,798,489 1/1989 Shiota ..... 400/240
4,884,907 12/1989 Yasumi ..... 400/216.1
5,039,240 8/1991 Hasegawa .
5,064,304 11/1991 Hosokawa et al. ..... 400/225
5,169,248 12/1992 Claudio et al. ..... 400/223

FOREIGN PATENT DOCUMENTS 0065928 12/1982 Fed. Rep. of Germany .
3890244T1 4/1989 Fed. Rep. of Germany .
249681 3/1905 Japan .
62-253480 11/1987 Japan .

*Primary Examiner*—Eugene H. Eickholt
*Attorney, Agent, or Firm*—Frishauf, Holtz, Goodman & Woodward

[57] ABSTRACT

A multi-color ribbon cassette position adjusting apparatus comprises a carrier having a print head, a cassette mounting member rockably supported on the carrier, and a fine adjustment mechanism attached to the cassette mounting member, for finely rocking the mounting member. The fine adjustment mechanism includes a guide member fixed to the cassette mounting member, a follower piece guided by the guide member to engage a helical cam for shifting the position of the cassette mounting member, and a position adjusting member for relatively moving the guide member and the follower piece.

11 Claims, 5 Drawing Sheets

MULTI-COLOR RIBBON CASSETTE POSITION ADJUSTING APPARATUS

BACKGROUND OF THE INVENTION

1. Field of the Invention

The present invention relates to a multi-color ribbon cassette position adjusting apparatus which is used in a color printer for multi-color printing, and in which a multi-color ribbon cassette having a multi-color ribbon therein is shifted with respect to a print head.

2. Description of the Related Art

In general, a color printer is designed so that a multi-color ribbon cassette, having a multi-color ribbon therein, is shifted with respect to a print head to select ink colors on the ribbon for color printing. A multi-color ribbon cassette position adjusting apparatus is used for the selection of the ink colors on the multi-color ribbon. Conventionally, the position adjusting apparatus comprises a shifting mechanism for actually shifting the position of the ribbon cassette, with respect to the print head, and a fine adjustment mechanism for fine adjustment such that the ribbon is regularly positioned with respect to the print head.

Disclosed in Published Unexamined Japanese Patent Application No. 62-253480 is a multi-color ribbon cassette shifting mechanism, which is arranged in the manner shown in FIG. 1. The construction of this conventional shifting mechanism will now be described in brief.

A carrier 51, which holds a print head 50 thereon, is supported for movement along carrier shafts 56. A ribbon plate 53 for holding a multi-color ribbon cassette 52 is urged in a direction perpendicular to the moving direction of the carrier 51, and is shiftable in this direction. A cam shaft 57, which extends parallel to the carrier shafts 56, is provided with a cam 54 which moves together with the carrier 51. The ribbon plate 53 is fitted with a cam follower 55 which engages the cam 54. As the cam 54 is rotated by means of the shaft 57, the ribbon cassette 52, along with the plate 53, shifts its position in the direction of the arrow. The cassette 52 contains a multi-color ribbon coated with different ink colors which are divided in the direction of the arrow.

In this arrangement, a paper sheet traveling on a cylindrical platen 58, part of which is exposed from a table 60, is subjected to color printing by moving the carrier 51 along the carrier shafts 56 and shifting the multi-color ribbon cassette 52 for ink color selection in the direction of the arrow.

Constructed in this manner, however, the multi-color ribbon cassette shifting mechanism is subject to the following drawbacks.

The ink colors of the multi-color ribbon are alternatively selected by moving the multi-color ribbon cassette 52 in the direction of the arrow. In order to select required colors without fail, therefore, the cam shaft 57 for holding the cam 54 must be kept accurately parallel to the carrier shafts 56. In the shifting mechanism shown in FIG. 1, however, the shaft 57 receives the urging force of the ribbon plate 53 through the cam follower 55, so that it is liable to deflection.

If the parallelism of the shaft 57 to the shafts 56 is inaccurate due to this deflection, the position of the ribbon plate 53 relative to the carrier 51 varies, and the ink colors cannot be accurately shifted with respect to the print head 50, so that the paper sheet may possibly undergo color mixture printing. In order to solve this problem, it is necessary to adjust the parallelism of the cam shaft 57 to the carrier shafts 56, thus entailing higher cost.

In some cases, each color of the multi-color ribbon may not be able to be located in position with respect to the print head 50, due to machining or assembling errors of the plate 53, cam 54, etc. Accordingly, two color coat portions of the ribbon may simultaneously get hit by the print head 50, for example, possibly resulting in color mixture printing on the paper sheet.

Conventionally, therefore, the multi-color ribbon cassette position adjusting apparatus comprises a fine adjustment mechanism for finely adjusting the position of the multi-color ribbon cassette 52 with respect to the print head 50 in order to compensate the machining or assembling errors. However, no such adjustment mechanism is described in the aforementioned patent application.

FIG. 2 illustrates another conventional example of a multi-color ribbon cassette position adjusting apparatus which comprises a shifting mechanism for actually shifting the position of the multi-color ribbon cassette, with respect to the print head, and a multi-color ribbon cassette fine adjustment mechanism for fine adjustment such that the ribbon is regularly positioned with respect to the print head.

The shifting mechanism of this position adjusting apparatus is provided with a ribbon plate **53*a* for holding a multi-color ribbon cassette 52 which contains a multi-color ribbon 52*a*. A follower piece 75, which is formed at one end portion of the plate 53*a*, is in engagement with a helical guide portion 73 formed on a shift cam 71 which rotates around an axis 72. The other end portion of the ribbon plate 53*a* is pivotally supported on a carrier 51*a* so as to be rockable around pivots 62**.

A drive motor 66, which is mounted on the carrier **51*a*, drives a train of gears 67 and 68 to rotate the shift cam 71. As the cam 71 rotates, the ribbon plate 53*a*, holding the multi-color ribbon cassette 52 thereon, is rocked around the pivots 62 through the medium of the helical guide portion 73 and the follower piece 75 in engagement with each other. By doing this, the position of the ribbon cassette 52 relative to the print head 50** is shifted.

Further, the shift cam 71 is provided with the multi-color ribbon fine adjustment mechanism 80, which serves to finely move the cam 71 in the direction of the axis 72. As the shift cam 71 finely moves in this manner, the ribbon plate **53*a* is slightly rocked around the pivots 62 through the medium of the helical guide portion 73 and the follower piece 75. By doing this, the multi-color ribbon 52*a* can be finely adjusted so that it is regularly positioned with respect to the print head 50**.

FIG. 3 is a sectional view illustrating the arrangement of the multi-color ribbon fine adjustment mechanism in detail. This mechanism comprises a shift cam stud 81 for supporting the shift cam 71 for rotation and movement in the direction of the axis 72, and an adjusting nut 82 which threadedly engages a thread portion **81*a* of the stud 81 so that the position of the cam 71 with respect to the direction of the axis 72 is shiftable. The fine adjustment mechanism further comprises members (wave washer 84, shift cam washer 85, E-ring 86, and adjusting spring 87) for preventing vibration of the shift cam 71 in rotation, and a stabilizer nut 88 for preventing the nut 82** from being unexpectedly rotated by vibration or the like.

This multi-color ribbon cassette position adjusting apparatus, however, is subject to the following drawbacks. As shown in FIG. 3, the multi-color ribbon cassette fine adjustment mechanism has a complicated construction, including many components, so that it is difficult to reduce its size and cost.

SUMMARY OF THE INVENTION

The object of the present invention is to provide a multi-color ribbon cassette position adjusting apparatus which has a simple construction including fewer components, and can prevent color mixture printing on paper.

In order to achieve the above object, a multi-color ribbon cassette position adjusting apparatus according to an aspect of the present invention comprises: a frame; a guide member supported on the frame; a carrier including a print head and supported for reciprocation along the guide member; a cassette mounting member holding a multi-color ribbon cassette containing a multi-color ribbon having a plurality of colors and rockably supported on the carrier so that any desired color can face the print head; a rotating shaft extending parallel to the guide member and supported on the frame, the rotating shaft being rotated by means of a drive source mounted on the frame; a driving gear mounted on the rotating shaft so as to be rotatable together therewith and a driven gear in mesh with the driving gear; sliding means for sliding the driving gear along the rotating shaft as the carrier reciprocates; and power transmission means attached to the cassette mounting member and the driven gear, for transmitting a rotary motion of the rotating shaft to the cassette mounting member so that the desired color of the multi-color ribbon faces the print head.

A multi-color ribbon cassette position adjusting apparatus according to another aspect of the present invention comprises: a carrier including a print head; a cassette mounting member rockably supported on the carrier and holding a multi-color ribbon cassette containing a multi-color ribbon coated with a plurality of colors; rocking means attached to the cassette mounting member, for finely rocking the cassette mounting member; and shifting means for shifting the position of the cassette mounting member through the medium of the rocking means so that each color on the multi-color ribbon faces the print head, the rocking means including a guide member fixed to the cassette mounting member, a follower piece guided by the guide member to engage the shifting means, and a position adjusting member for relatively moving the guide member and the follower piece.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 4:
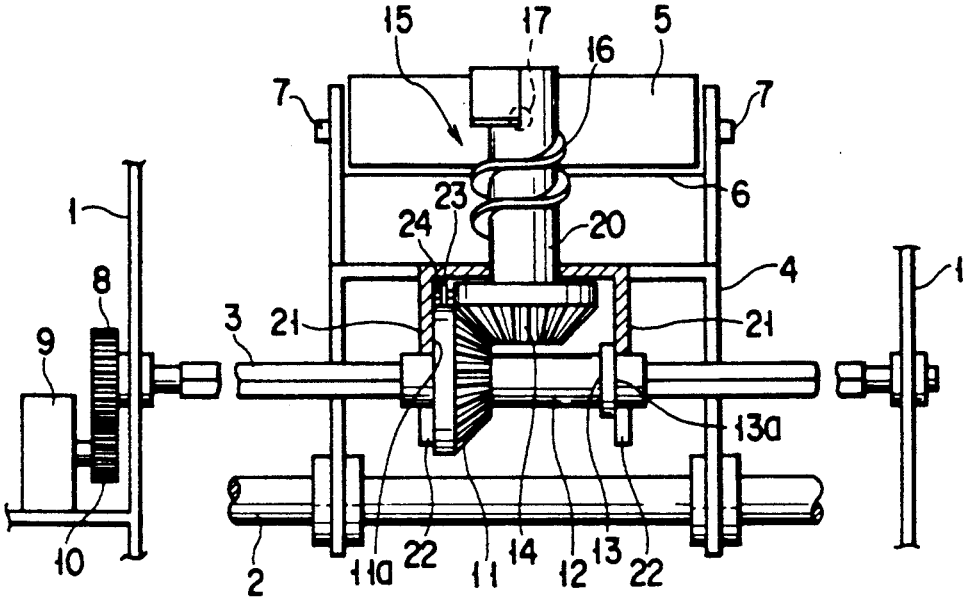
FIG. 4 is a front view, partially in section, illustrating a multi-color ribbon cassette shifting mechanism of a multi-color ribbon cassette position adjusting apparatus according to an embodiment of the present invention.
Figure 5:
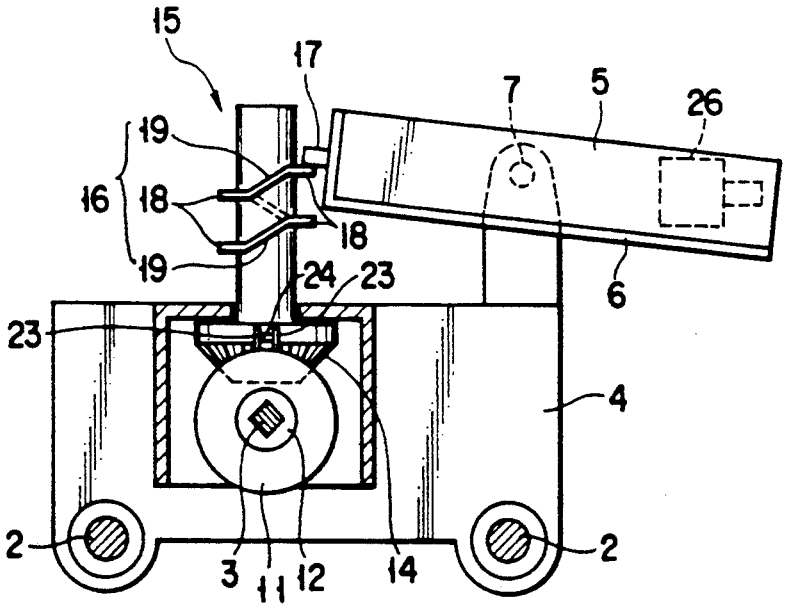
FIG. 5 is a side view, partially in section, illustrating the multi-color ribbon cassette shifting mechanism shown in FIG. 4.
Figure 6:
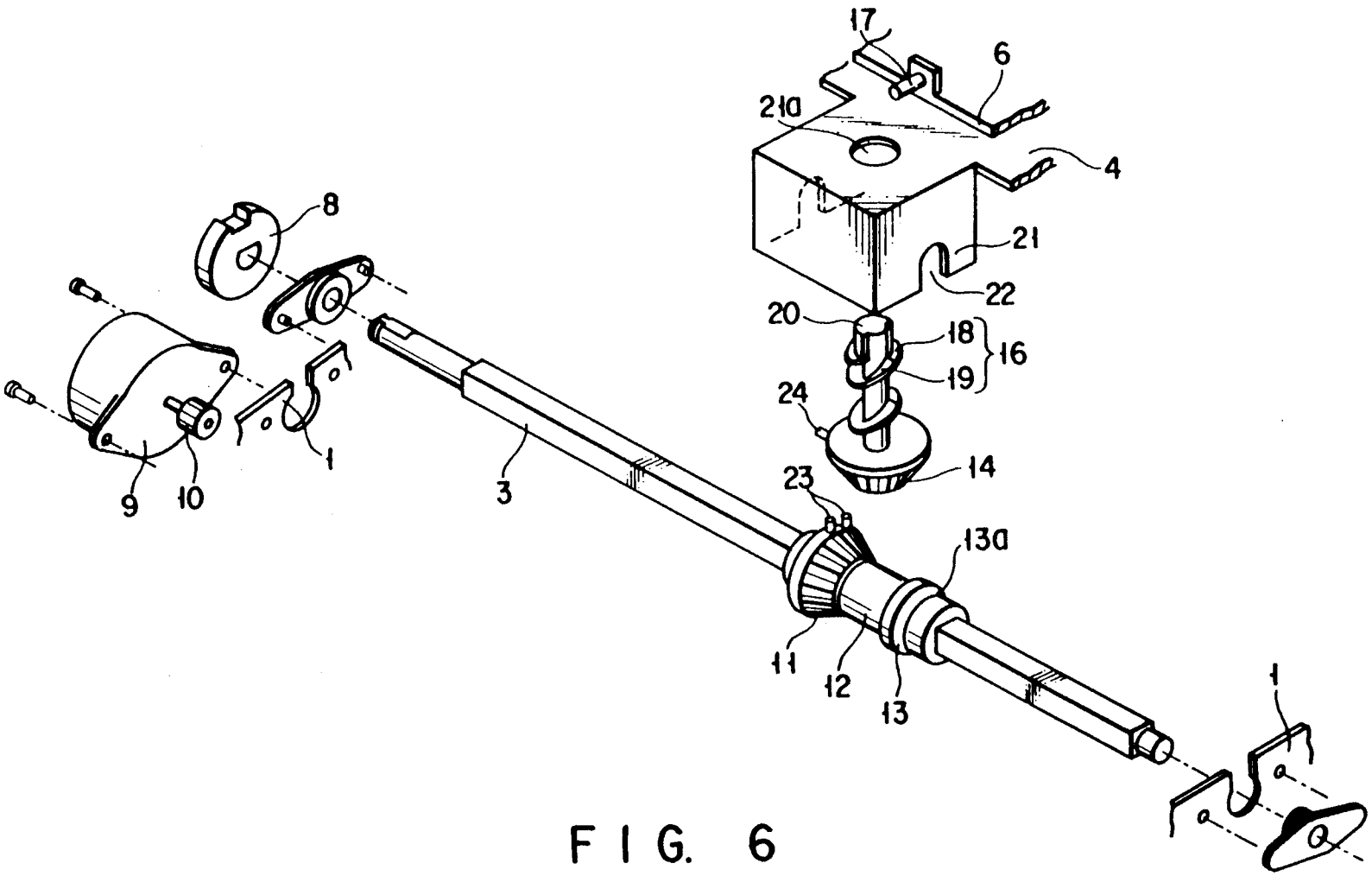
FIG. 6 is an exploded perspective view illustrating the multi-color ribbon cassette shifting mechanism shown in FIG. 4.

A first embodiment of the present invention will now be described with reference to the accompanying drawings of FIGS. 4 to 6. Supported on facing frames 1 are carrier shafts 2, which extend parallel to each other in the horizontal direction, and a rotating shaft 3 extending parallel to the carrier shafts and arranged for rotation. The whole body of the shaft 3 except its bearing end portions is formed having a square cross section. A carrier 4, which is slidably supported on the carrier shafts 2, is slid along the shafts 2 by means of a drive mechanism (not shown). This drive mechanism is a conventional one which converts a rotary motion of a reversible motor into a linear motion and transmits it to the carrier 4 by means of a belt or wire, for example.

A cassette mount 6, which is furnished with a print head 26 and removably holds a multi-color ribbon cassette 5, is supported on the carrier 4 by means of pivots 7 so as to be rockable at right angles to the moving direction of the carrier 4.

A gear 8 is fixed to one end portion of the rotating shaft 3 with a frame 1 between them. The gear 8 is in mesh with a gear 10 which is mounted on the driving shaft of a reversible motor 9 on the frame 1. A sleeve 12 having a circular outer peripheral surface is held for axial sliding motion on the square-sectioned portion of the shaft 3. A flange 13 is formed on one end portion of the sleeve 12. A driving gear 11 formed of a bevel gear is fixed to the other end portion of the sleeve 12.

The carrier 4 is formed having a contact member 21 which engages a thrust surface 11*a* of the driving gear 11 and a thrust surface 13*a* of the flange 13. The member 21 has notches 22 which receive the sleeve 12.

Thus, when the rotating shaft 3 is rotated by the motor 9, the driving gear 11 is rotated with the shaft 3. When the carrier 4 is driven along the carrier shafts 2, moreover, the driving gear 11 is axially slid together with the sleeve 12 by the contact member 21.

A hole 21*a* is bored through the top face of the contact member 21, and a rotating shaft 20, which extends at right angles to the rotating shaft 3, is held in the hole 21*a*. A driven gear 14 in mesh with the driving gear 11 is fixed to an end portion of the shaft 20. The driven gear 14 is also formed of a bevel gear. Thus, when the driving gear 11 rotates, the rotating shaft 20 is rotated by means of the driven gear 14.

The rotating shaft 20 and the cassette mount 6 are provided with a power transducer mechanism 15 which converts a rotary motion of the shaft 20 into a vertical motion and transmits it to the mount 6. The mechanism 15 includes a helical cam 16 formed integrally on the rotating shaft 20 and a pin 17 protruding from an end portion of the cassette mount 6 and adapted to engage the cam 16. As shown in FIG. 5, the helical cam 16 has a plurality of flat faces 18, which extend at right angles to the axis of the rotating shaft 20 and support the pin 17, and slopes 19 connecting the faces 18. The axial interval between each two adjacent flat faces 18 corresponds to the width of an ink color region on a multi-color ribbon, which is housed in the multi-color ribbon cassette 5 on the cassette mount 6. Thus, as the rotating shaft 20 rotates, the position of the multi-color ribbon cassette on the mount 6, that is, the ink colors on the multi-color ribbon, are changed.

Two pins 23, which are arranged in close vicinity to each other, protrude from the outer periphery of the driving gear 11. A pin 24 protrudes from the outer periphery of the driven gear 14 so as to be situated between the pins 23. As mentioned before, the axial interval between each two adjacent flat faces 18 corresponds to the width of the ink color region on the multi-color ribbon contained in the multi-color ribbon cassette 5 on the cassette mount 6. It is necessary, therefore, to set the home position of the cassette mount 6. This home position can be easily set in the following manner.

The motor 9 is rotated so that the pins 23 of driving gear 11 reach their respective top positions, and an excitation layer of the motor 9 obtained at that time is stored in memory. The pin 24 of the driven gear 14 is located between the pins 23 of the driving gear 11 stopped in this state, and the pin 17 of the cassette mount 6 is caused to engage a predetermined one of the flat faces 18 of the helical cam 16. The state in which the pin 17 is in engagement with the predetermined flat face defines the home position of the multi-color ribbon cassette. As the driving gear 11 rotates, the pin 24 of the driven gear 14 can be removed from between the pins 23 of the gear 11 without any problem.

The following is a description of the operation of the multi-color ribbon cassette shifting mechanism.

During printing operation, the carrier 4 is driven along the carrier shafts 2. Since the sleeve 12, with the driving gear 11 fixed thereon, moves along the rotating shaft as the contact member 21 pushes the thrust surface 11*a* and the thrust surface 13*a* of the flange 13, the driven gear 14 is always in mesh with the gear 11. Thus, when the rotating shaft 3 is rotated by the motor 9, this rotation is transmitted through the driving gear 11 to the driven gear 14, whereupon the rotating shaft 20, having the helical cam 16 thereon, is driven.

The pin 17 of the cassette mount 6 is caused continually to engage the helical cam 16 by means of a spring (not shown) or by gravity, and the mount 6 is rocked around the pivots 7 as the cam 16 rotates. Thus, a desired ink coat on the ink ribbon of the multi-color ribbon cassette 5 can be opposed to the print head by stopping the motor 9 while keeping the pin 17 in engagement with one of the flat faces 18.

A pressure acting on the spot of engagement between the driving and driven gears 11 and 14 is reduced by backlash caused between the gears, whereby deflection of the rotating shaft 3 is prevented. Even if the parallelism of the shaft 3 to the moving direction of the carrier 4 is inaccurate, moreover, variation of the shift position of the cassette mount 6, which is attributable to the change of the position of the carrier 4, is absorbed by the backlash at the spot of engagement between the gears 11 and 14. Accordingly, the accuracy of multi-color ink ribbon shifting can be improved without entailing any complicated adjustment work.

According to this embodiment, the carrier 4 need not be furnished with the motor 9 for driving the driven gear 14, so that circuit components that must be mounted on the carrier 4 can be reduced to the minimum. That is to say, those circuit components necessary for the motor 9, such as a circuit board, flexible cables, connectors, etc., can be eliminated except for those necessary for the print head only. As a result, the weight of the carrier 4 can be reduced, and deflection of the rotating shaft 3 can be prevented.

Figure 7:
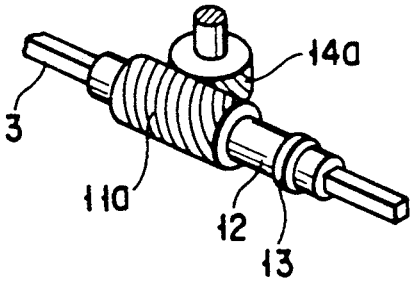
FIG. 7 illustrates a modification of a driving force transmission section of the multi-color ribbon cassette shifting mechanism shown in FIG. 4.

In this embodiment, moreover, a bevel gear is used as each of the driving and driven gears 11 and 14 for transmitting the driving force of the rotating shaft 3 to the shaft 20. As shown in FIG. 7, in this case, a worm gear 11*a* and a worm wheel 14*a* may be used as the driving and driven gears, respectively, with the same result. It is to be understood that a worm wheel and a worm gear may be used as the driving and driven gears, respectively.

Alternatively, a cylindrical gear and a rack may be used as the driving and driven gears, respectively. In this case, the cassette mount 6 can be shifted by only operating the rack for up-and-down motion. Thus, it is unnecessary to use the helical cam 16 for shifting the cassette mount, so that the construction is simpler.

Referring now to FIGS. 8 to 11, a second embodiment of the present invention will be described. A feature of this embodiment lies in the arrangement of a multi-color ribbon fine adjustment mechanism. In the accompanying drawings, like reference numerals refer to the same parts throughout the several views.

Figure 8:
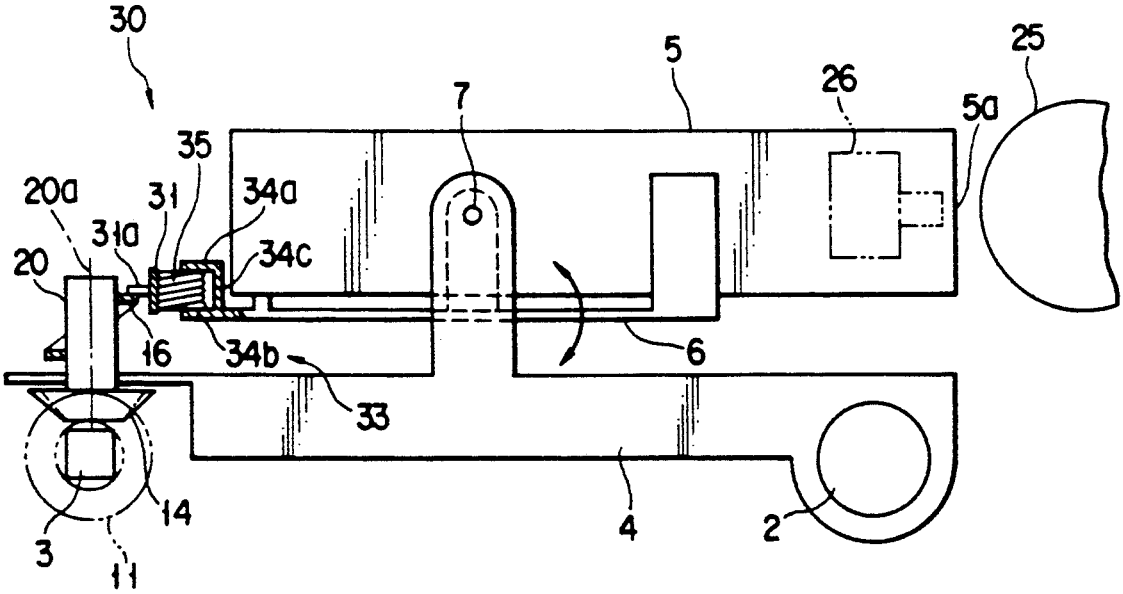
FIG. 8 is a side view illustrating a multi-color ribbon cassette position adjusting apparatus according to another embodiment of the invention.

FIG. 8 is a view illustrating the general arrangement of a multi-color ribbon cassette position adjusting apparatus which is provided with the multi-color ribbon fine adjustment mechanism 30.

A carrier 4, which holds a print head 26 thereon, is slidably mounted on carrier shaft 2. A cassette mount 6 for holding a multi-color ribbon cassette 5, which contains a multi-color ribbon 5*a*, is pivotally supported on the carrier 4 so as to be rockable around pivots 7.

A rotating shaft 3, which extends parallel to the carrier shaft 2, is fitted with a driving gear 11 which rotates together therewith. The gear 11 is in mesh with a driven gear 14 on a rotating shaft 20 which extends at right angles to the shaft 3. Each of these gears 11 and 14 is formed of a bevel gear. Thus, as the rotating shaft 3 rotates, the rotating shaft 20 is rotated by means of the driving and driven gears 11 and 14.

A helical cam 16 is formed integrally on the rotating shaft 20. A follower pin 31*a* of the multi-color ribbon fine adjustment mechanism 30, which is provided at an end portion of the cassette mount 6, abuts against the cam face of the cam 16. The pin 31*a* is caused continually to engage the cam face of the helical cam 16 by means of a spring (not shown) or by gravity. As in the case of the foregoing embodiment, therefore, the cassette mount 6 is rocked in the direction indicated by the arrow around the pivots 7 as the cam 16 rotates. Thus, a desired ink coat on the multi-color ribbon 5*a* of the multi-color ribbon cassette 5 can be opposed to the print head 26.

Figure 9:
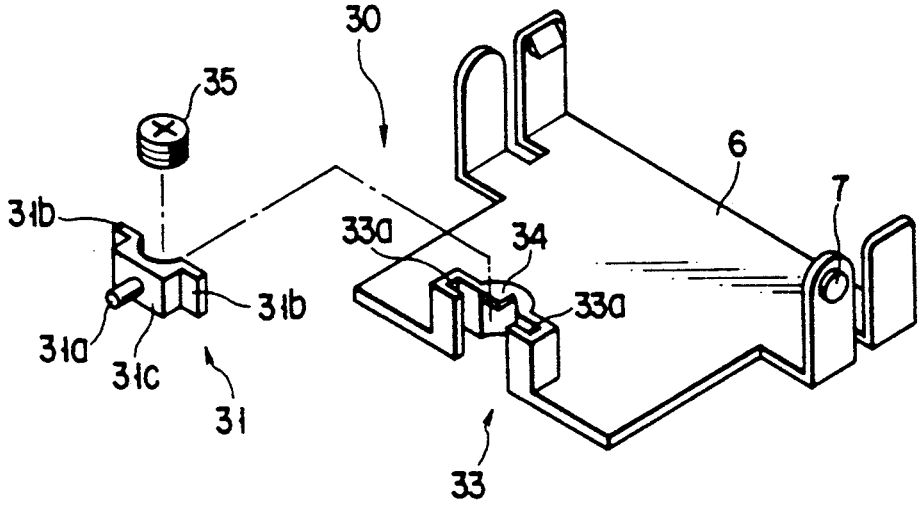
FIG. 9 is an enlarged perspective view illustrating a multi-color ribbon fine adjustment mechanism of the multi-color ribbon cassette position adjusting apparatus shown in FIG. 8.
Figure 10:
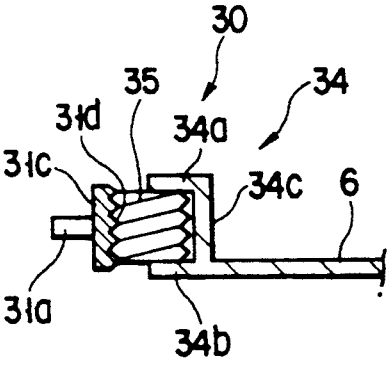
FIG. 10 is a sectional view illustrating the principal part of the multi-color ribbon fine adjustment mechanism shown in FIG. 9.
Figure 11:
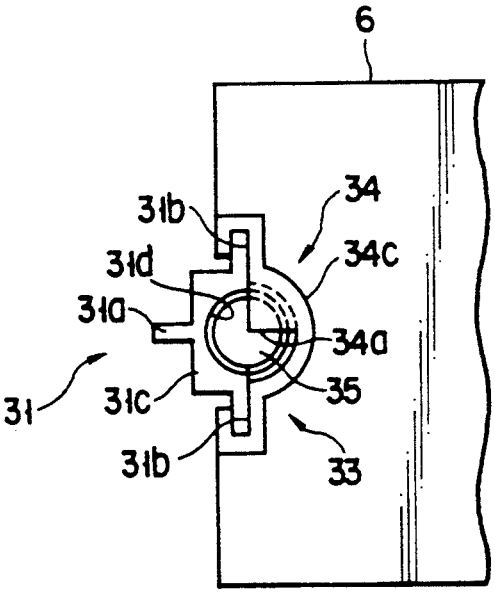
FIG. 11 is a plan view illustrating the multi-color ribbon fine adjustment mechanism shown in FIG. 9.

Referring now to FIGS. 9 to 11, the arrangement of the multi-color ribbon fine adjustment mechanism 30 will be described in detail.

A guide member 33 is formed at the end portion of the cassette mount 6, and the follower pin 31*a* protrudes from a projection 31*c* of a follower piece 31, which is interposed between the member 33 and the helical cam 16. The guide member 33 includes a pair of guide grooves 33*a* which extend at right angles to the cassette mount 6. A pair of sliding lugs 31*b* of the follower piece 31 are fitted individually in the grooves 33*a* for sliding motion in the shifting direction of the mount 6.

The guide member 33 is formed with a semicircular barrel portion 34 which receives an adjust screw 35. The barrel portion 34 includes position regulating portions 34*a*, 34*b* and 34*c* for restraining the screw 35 from moving vertically and horizontally. The screw 35 is supported for rotation within a space defined by these position regulating portions.

The projection 31*c* of the follower piece 31 is formed having a half nut portion 31*d*, and the adjust screw 35 is in mesh with the portion 31*d*. Thus, as the screw 35 is rotated, the relative positions of the follower piece 31 and the cassette mount 6 are finely shifted. The position regulating portion 34*a* has a notch which facilitates the rotation of the adjust screw 35.

The following is a description of the operation of this embodiment.

When the rotating shaft 3 is rotated by means of a drive motor (not shown), the cassette mount 6 is rocked in the direction indicated by the arrow around the pivots 7, by means of the helical cam 16 and the follower pin 31*a*. As a result, the position of the multi-color ribbon cassette is shifted, and a desired color of the ink coat on the multi-color ribbon 5*a* is aligned with the print head 26.

In this case, if the desired color is not accurately in alignment with the print head 26 due to machining or assembling errors of the cassette mount 6, helical cam 16, etc., the adjust screw 35 is finely rotated as required. When the screw 35 is rotated, it is finely moved in the vertical direction. As mentioned before, the follower pin 31*a* is continually urged toward the cam face of the helical cam 16, and the adjust screw 35 is restrained from moving in the vertical direction by the position regulating portions 34*a* and 34*b*. As the screw 35 finely moves, therefore, guide member 33 finely moves along the sliding lugs 31*b* of the follower piece 31. As a result, the cassette mount 6 is rocked for a fine angle in the direction of the arrow around the pivots 7, corresponding to the fine movement of the guide member 33.

The multi-color ribbon 5*a* of the multi-color ribbon cassette 5, held on the cassette mount 6, can be finely adjusted so that it is accurately positioned with respect to the print head 26, by rotating the adjust screw 35 as required in the aforesaid manner. After this fine adjustment, the position of the ribbon cassette can be accurately shifted by means of a cassette shifting mechanism, so that high-quality multi-color prints can be obtained.

Figure 1:
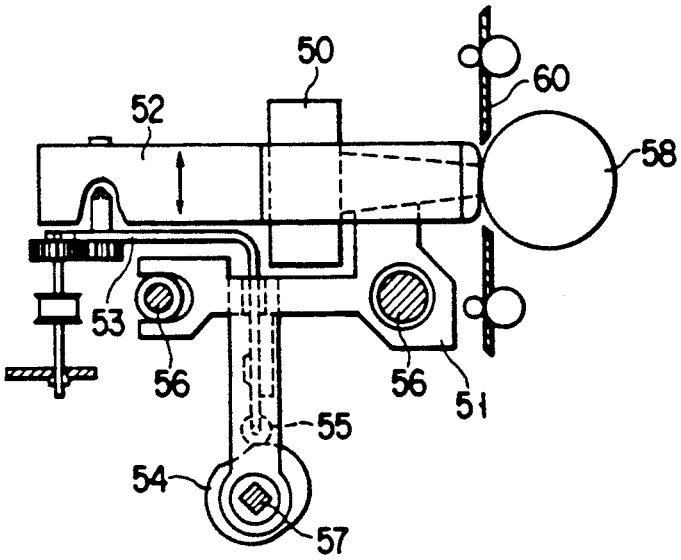
PRIOR ART FIG. 1
FIG. 1 illustrates an arrangement of a conventional multi-color ribbon cassette position adjusting apparatus.
Figure 2:
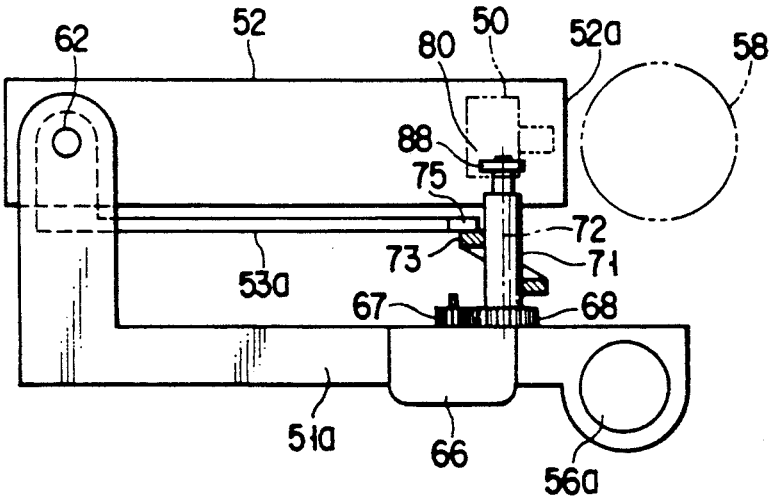
PRIOR ART FIG. 2
FIG. 2 illustrates another arrangement of a conventional multi-color ribbon cassette position adjusting apparatus.
Figure 3:
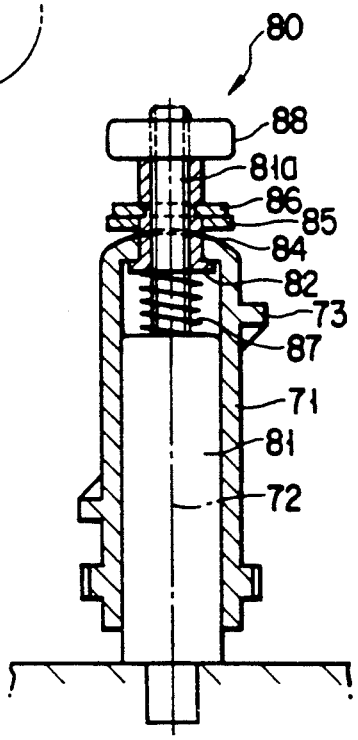
PRIOR ART FIG. 3
FIG. 3 is a partial sectional view illustrating a detailed arrangement of a multi-color ribbon fine adjustment mechanism of the multi-color ribbon cassette position adjusting apparatus shown in FIG. 2.

In the conventional multi-color ribbon cassette position adjusting apparatus shown in FIGS. 2 and 3, the position of the multi-color ribbon cassette is shifted by rotating the shift cam 71, and is finely adjusted by moving the cam 71 in the direction of the axis 72. More specifically, the shifting mechanism and the fine adjustment mechanism for the ribbon cassette are formed integrally with the cam 71. It is necessary, therefore, to provide the members (wave washer 84, shift cam washer 85, E-ring 86, and adjusting spring 87) for preventing vibration of the shift cam 71 in rotation and the stabilizer nut 88 for preventing the adjusting nut 82 from being unexpectedly rotated by vibration or the like.

According to the present invention, in contrast with this, the multi-color ribbon fine adjustment mechanism is arranged between the rotating shaft 20 with the helical cam 16 thereon and the cassette mount 6, so that the aforesaid vibration preventing members need not be used. As a result, the construction is simplified, and the components used are reduced in number. Thus, the multi-color ribbon cassette position adjusting apparatus can be reduced in size and in cost, and can be assembled quickly and easily It is to be understood that the multi-color ribbon fine adjustment mechanism 30 may be incorporated in the region for the pin 17 of the multi-color ribbon cassette shifting mechanism shown in FIG. 5.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A multi-color ribbon cassette position adjusting apparatus comprising:

a frame;

a guide member supported on the frame;

a carrier including a print head and supported for reciprocation along the guide member;

a cassette mounting member holding a multi-color ribbon cassette containing a multi-color ribbon having a plurality of colors and rockably supported on the carrier so that any desired color may face the print head;

a rotating shaft extending parallel to the guide member and supported on the frame, the rotating shaft being rotated by means of a drive source mounted on the frame;

a driving gear mounted on the rotating shaft so as to be rotatable together therewith and a driven gear in mesh with the driving gear;

sliding means for sliding the driving gear along the rotating shaft as the carrier reciprocates; and power transmission means attached to the cassette mounting member and the driven gear, for transmitting a rotatory motion of the rotating shaft to the cassette mounting member so that the desired color of the multi-color ribbon faces the print head.

2. A multi-color ribbon cassette position adjusting apparatus according to claim 1, wherein said driving and driven gears are formed of a bevel gear each.

3. A multi-color ribbon cassette position adjusting apparatus according to claim 1, wherein said power transmission means includes a rotating shaft attached to the driven gear, a helical cam formed on the rotating shaft, and an engaging member attached to the cassette mounting member and engaging the helical cam.

4. A multi-color ribbon cassette position adjusting apparatus according to claim 1, wherein said helical cam has a plurality of flat faces corresponding individually to the colors of the multi-color ribbon, and one of the colors of the multi-color ribbon faces the print head when the engaging member engages one of the flat faces.

5. A multi-color ribbon cassette position adjusting apparatus according to claim 1, wherein said driving and driven gears include home position setting means for setting a home position between the print head and the multi-color ribbon.

6. A multi-color ribbon cassette position adjusting apparatus according to claim 1, wherein said sliding means includes a cylindrical member loosely fitted on the rotating shaft and fixedly fitted with the driving gear, a flange attached to the cylindrical member, and a contact member attached to the carrier and engaging the respect thrust surfaces of the driving gear and the flange.

7. A multi-color ribbon cassette position adjusting apparatus according to claim 1, wherein said driving and driven gears are formed of a worm gear and a worm wheel, respectively.

8. A multi-color ribbon cassette position adjusting apparatus comprising:

a carrier having a print head;

a cassette mounting member rockably supported on the carrier and holding a multi-color ribbon cassette containing a multi-color ribbon coated with a plurality of colors;

rocking means attached to the cassette mounting member, for finely rocking the cassette mounting member; and shifting means for shifting the position of the cassette mounting member through the medium of the rocking means so that each color on the multi-color ribbon faces the print head, the rocking mean including a guide member fixed to the cassette mounting member, a follower piece guided by the guide member to engage the shifting means, and a position adjusting member for relatively moving the guide member and the follower piece.

9. A multi-color ribbon cassette position adjusting apparatus according to claim 8, wherein said shifting means includes a rotating shaft controlled in rotation by means of a drive motor and a helical cam provided on the rotating shaft and adapted to be in contact with the follower piece.

10. A multi-color ribbon cassette position adjusting apparatus according to claim 9, wherein said position adjusting member comprises a screw held by means of the guide member, and said follower piece includes a thread in mesh with the screw.

11. A multi-color ribbon cassette position adjusting apparatus comprising:

a frame;

a guide member supported on the frame;

a carrier including a print head and supported for reciprocation along the guide member;

a cassette mounting member holding a multi-color ribbon cassette containing a multi-color ribbon coated with a plurality of colors and rockably supported on the carrier so that any desired color is facing the print head; and a rotating shaft extending parallel to the guide member and supported on the frame, the rotating shaft being rotated by means of a drive source mounted on the frame;

a driving gear mounted on the rotating shaft so as to be rotatable together therewith and a driven gear in mesh with the driving gear;

sliding means for sliding the driving gear along the rotating shaft as the carrier receiprocates;

a shift cam provided on the driven gear, for shifting the position of the cassette mounting member so that each color on the multi-color ribbon faces the print head; and rocking means attached to the cassette mounting member, for finely rocking the cassette mounting member, the rocking means including a guide member fixed to the cassette mounting member, a follower piece guided by the guide member to engage the shift cam, and a position adjusting member for relatively moving the guide member and the follower piece.

* * * * *